US007540462B1

(12) United States Patent
Beden

(10) Patent No.: US 7,540,462 B1
(45) Date of Patent: Jun. 2, 2009

(54) HOLDER FOR A MIXING BUCKET

(76) Inventor: Gerald Beden, 7980 Summerlin Lakes Dr., Suite 201, Fort Myers, FL (US) 33907

( * ) Notice: Subject to any disclaimer, the term of this patent is extended or adjusted under 35 U.S.C. 154(b) by 210 days.

(21) Appl. No.: 11/342,157

(22) Filed: Jan. 27, 2006

(51) Int. Cl.
*A47B 91/00* (2006.01)

(52) U.S. Cl. ..... 248/346.03; 248/146

(58) Field of Classification Search ..... 248/346.03, 248/346.5, 146, 310, 314, 315; 220/737–744; 222/83.6, 86, 88
See application file for complete search history.

(56) References Cited

U.S. PATENT DOCUMENTS 4,071,163 A * 1/1978 Martin ..... 220/630
7,063,648 B1 * 6/2006 Brigham ..... 482/83
7,131,618 B2 * 11/2006 Berry et al. ..... 248/346.05
2004/0021043 A1 * 2/2004 Zagorsky ..... 248/146
2005/0045780 A1 * 3/2005 Forshee et al. ..... 248/146
2006/0124808 A1 * 6/2006 Hibbler ..... 248/146
2006/0202093 A1 * 9/2006 Grosse ..... 248/146
2006/0231562 A1 * 10/2006 Carroll ..... 220/737
2007/0012706 A1 * 1/2007 Deadman ..... 220/737

* cited by examiner

*Primary Examiner*—Ramon O Ramirez
(74) *Attorney, Agent, or Firm*—William E. Noonan

(57) ABSTRACT

A holder for a mixing bucket includes a base upon which a person mixing the contents of the bucket stands upon and holds in place. A bucket retainer is attached to and extends upwardly from the base. The retainer is disposable peripherally about the bucket and restricts movement of the bucket while the contents of the bucket are mixed by a person standing on the base.

13 Claims, 3 Drawing Sheets

HOLDER FOR A MIXING BUCKET

FIELD OF THE INVENTION

This invention relates to a holder for a mixing bucket and, more particularly, to a device that holds a bucket containing mortar, thinset and similar construction substances in place so that mixing of the contents is facilitated.

BACKGROUND OF THE INVENTION

Various fields of construction employ adhesive compositions that must be thoroughly mixed prior to their application. For example, thinset and grout are utilized in all sorts of tile settings. Mortar and other cementitious materials are similarly employed in various masonry applications such as bricklaying. Before these substances are applied, they must first be thoroughly mixed in water. Traditionally, such mixing is performed in a mixing bucket, using a mixing blade that is attached, for example, to a low speed drill.

Thoroughly mixing a viscous construction material can be extremely time consuming, tedious and labor intensive. As the mixer is operated, it is apt to disrupt and possibly knock over the mixing bucket. Accordingly, while one worker operates the mixer, a second worker is usually required to hold the bucket in place. It is normally far too awkward for a single worker to perform both tasks. Requiring the time and attention of two workers to perform the mixing operation is obviously quite inefficient.

An additional problem encountered during conventional mixing operations is that the composition being mixed is often splashed or other discharged from the bucket. This wastes material and creates a mess that must be cleaned from clothing, tools and the surrounding work area.

SUMMARY OF THE INVENTION

It is therefore an object of the present invention to provide a holder for securely retaining a mixing bucket in place so that the contents of the bucket can be quickly and conveniently mixed by a single worker using a standard mixing machine.

It is a further object of this invention to significantly reduce the time, tedium and labor required to mix thinset, mortar and other cementitious materials.

It is a further object of this invention to provide a holder that conveniently accommodates virtually all sizes of mixing buckets so that the contents of the bucket can be mixed quickly and conveniently by a single worker.

It is a further object of this invention to provide a holder for a mixing bucket that significantly reduces the amount of mixed material that is splashed or otherwise discharged during the mixing process and which therefore reduces material waste and the need for time consuming and inefficient cleanup.

It is a further object of this invention to provide a holder for a mixing bucket that is extremely simple to set up and use.

This invention results from a realization that construction materials such as mortar and thinset may be quickly and conveniently mixed in a standard bucket by a single worker through the use of a holder apparatus that secures the mixing bucket in place during the mixing operation and without requiring a second worker to secure the bucket in place. This invention results from the further realization that a single worker can must more easily hold the mixing bucket in place by utilizing a mat-like base to which the mixing bucket is secured and upon which the worker stands to restrict movement and tipping of the bucket.

This invention features a holder for a mixing bucket, the contents of which bucket are mixable therein. The holder includes a base for being stood upon and held in place by a person mixing the contents of the bucket. A bucket retainer is attached to and extends upwardly from the base. The retainer is disposed peripherally about the bucket and restricts movement thereof while the contents of the bucket are mixed by a person standing on the base.

In a preferred embodiment, the base includes a generally flat platform. The retainer may include a retaining ring that extends axially upwardly from the base and has a central opening for receiving the bucket with mixable contents therein.

A peripheral shield may be attachable to and extendable above the retainer for surrounding the bucket disposed within the retainer to limit discharge of the contents of the bucket while the contents are being mixed. The retainer may include a channel or groove for receiving the shield to attach the shield to the retainer. The shield may include a flexible, generally flat shield component that is wrappable into a generally cylindrical closed condition for inserting the shield into the annular groove. The shield component may include complementary fastening elements located proximate respective ends of the shield component. The fastening elements are selectively interengagable to hold the shield component in the generally cylindrical closed condition.

When the retainer includes a retaining ring, the groove typically has an annular shape. Likewise, the shield is generally cylindrical. The retaining ring or other retainer may be configured for peripherally engaging the mixing bucket and frictionally gripping the bucket to restrict movement thereof while the contents of the bucket are mixed. The retaining ring may include a longitudinally tapered interior circumferential surface for frictionally engaging and holding buckets of varying diameters at respective depths within the retaining ring. The retaining ring may include an interior circumference that increases from an upper end to a lower end of the ring. As a result, the ring is peripherally, frictionally engagable with progressively smaller diameter buckets as the depth within the ring increases.

DETAILED DESCRIPTION OF PREFERRED EMBODIMENTS

Other objects, features and advantages will occur from the following description of a preferred embodiment and the accompanying drawings, in which.

Figure 1:
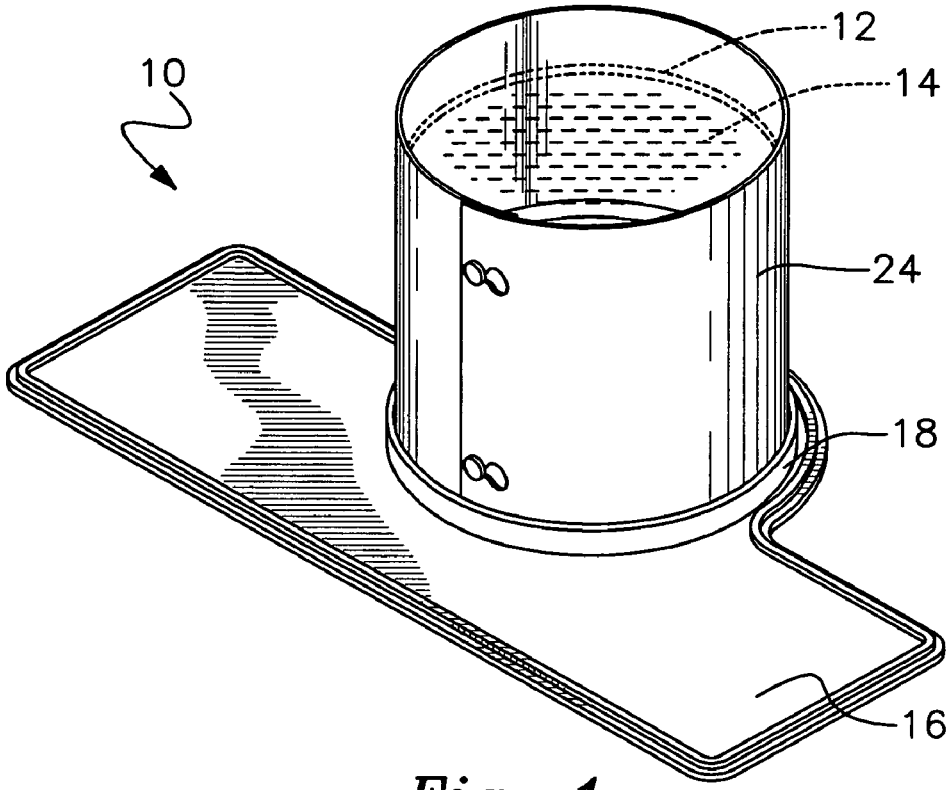
FIG. 1 is a peripheral view of a preferred mixing bucket holder in accordance with this invention.

There is shown in FIG. 1 a holder device 10 for accommodating a mixing bucket 12, shown in phantom. The mixing bucket is a standard construction product filled with a viscous adhesive composition 14 such as mortar, cement, grout, thinset, etc. This composition is conventionally mixed with water and then employed in a standard manner in the building or construction industries. Traditionally, after water and composition 14 are added to the mixing bucket, one worker holds the bucket in place while a second worker operates a drill mounted mixing tool. Holder 10 eliminates the requirement for two workers and holds bucket 12 and contents 14 securely in place so that the mixing operation may be performed quickly and efficiently by one person.

Holder 14 includes a generally flat base 16. The base may comprise a mat or other substantially flat platform that is large enough to be stood upon by the worker performing the mixing operation. Base 16 typically comprises a molded synthetic material. Teflon® or the like may be utilized to provide a non-stick surface.

An annular retaining ring 18 is unitarily connected to and extends upwardly from an upper surface of base 16. The retaining ring is illustrated more clearly in FIG. 2. Ring 18 includes a channel section 20 formed at its lowermost end and attached directly to the upper surface of base 16. Channel section 20 includes an annular channel or groove 22 that extends peripherally about the entire retaining ring. The groove receives the lower end of a protective shield 24 in the manner shown in FIG. 1. The shield itself is shown alone in FIG. 3. Protective shield 24 is constructed and operates in a manner described more fully below.

Figure 2:
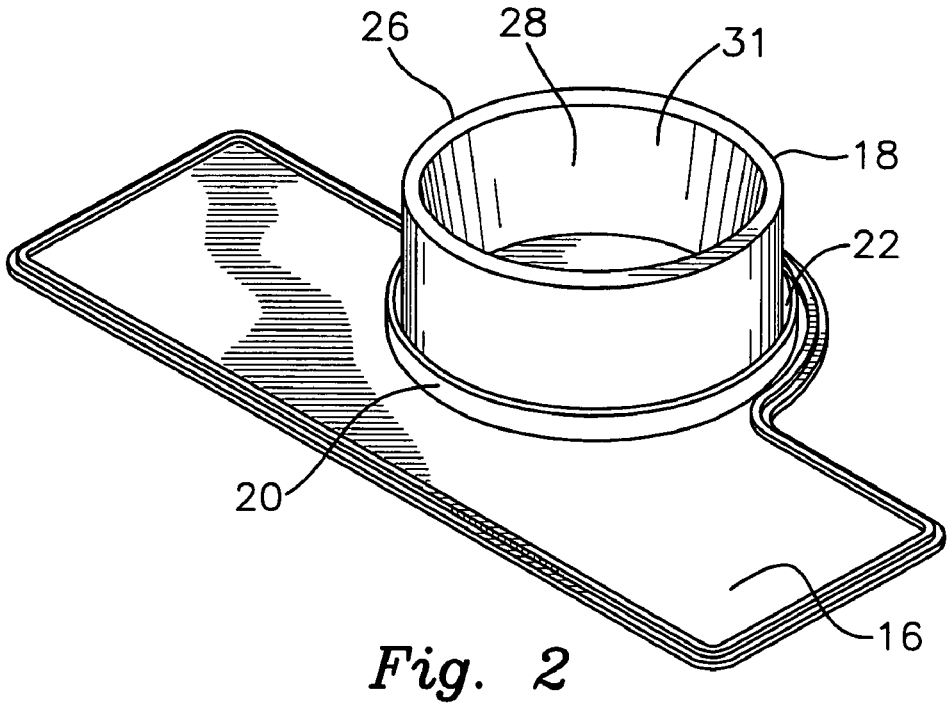
FIG. 2 is a peripheral view of the base and attached retaining ring of the holder.

Retaining ring 18 further includes a generally cylindrical body 26 that extends upwardly and unitarily from channel section 20 in the manner shown in FIG. 2. A central opening 28 is formed through the retaining ring. As is described more fully below, the interior circumference 31 of body 26 is tapered inwardly from top to bottom. The diameter of the inner circumference decreases with depth. This allows the retaining ring to securely grip various sizes of mixing buckets as described below. Retaining ring 18 should be composed of a material that is similar to that forming the base 16. In particular, Teflon® or other non-stick material may be used.

Preferably, retaining ring 18 is formed in a single piece with base 16. The one-piece component may be molded or manufactured in other manners. In alternative embodiments, the retaining ring and base may comprise separate and distinct components that are fastened together following manufacturing.

Figure 3:
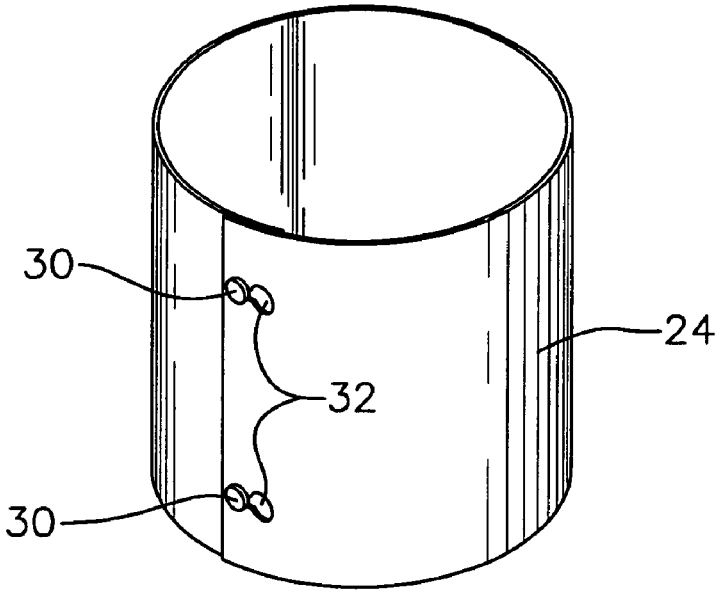
FIG. 3 is a peripheral view of the protective cylindrical shield in an assembled condition.
Figure 4:
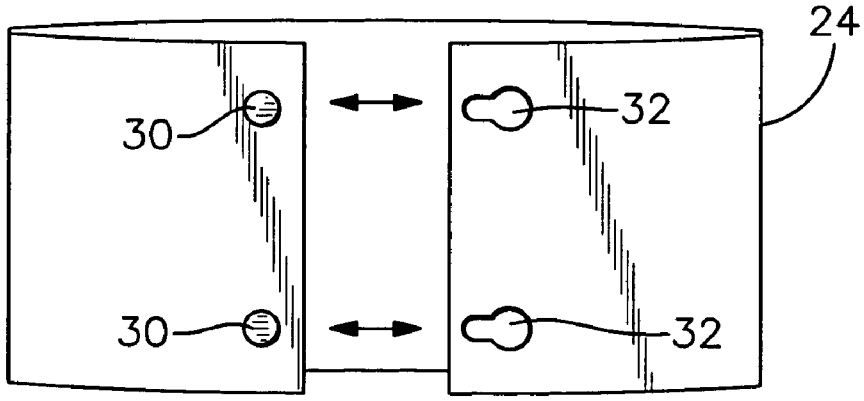
FIG. 4 is a front elevational view of the shield prior to its assembly.

Protective shield 24 is selectively secured to retaining ring 18. More particularly, the protective shield comprises a resiliently flexible sheet of Teflon® or other non-stick synthetic material. As shown in FIG. 4, shield 24 may be alternated between an open, generally flattened condition and a closed cylindrical condition. The latter constitutes the assembled condition for the shield and is best depicted in FIGS. 1 and 3. Preliminarily, the protective shield constitutes a flat sheet. Fasteners are formed at respective ends of the sheet. In particular, the shield carries a pair of buttons 30 that protrude from an outer side of the shield proximate one end thereof. A corresponding pair of fastening slots 32 are formed through the shield proximate the opposite end. To assemble the shield, the respective ends of the shield are simply interengaged. Each of the buttons or tabs 30 is inserted through the enlarged end of a respective slot 32. The buttons are then slid into the narrow portions of openings 32 and the shield is fastened to itself so that the cylindrical shape in FIG. 3 is formed. The cylinder has a size that generally corresponds to the size of the annular groove 22 in channel 20. The lower end of shield 24 is then inserted into groove 22 in the manner shown in FIG. 5.

Figure 5:
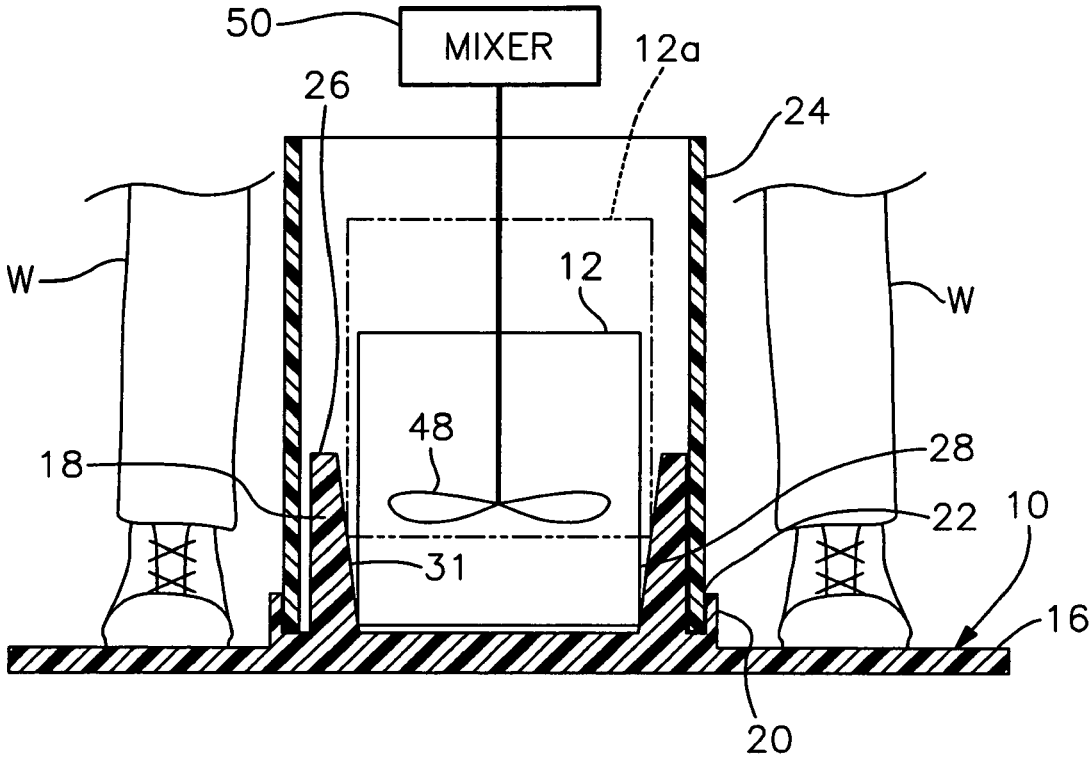
FIG. 5 is a front, cross sectional view of the holder with a worker standing thereon and with a mixer (illustrated partly in schematic) engaged with the contents of a mixing bucket accommodated by the holder.

As shown in FIG. 5, body 26 of retaining ring 18 includes an inner circumferential surface 31 that tapers inwardly from an upper end of body 26 to a lower end of the body. This allows the retaining ring 18 to frictionally engage the periphery of virtually any size of mixing bucket 12. In particular, as depicted in FIG. 5, bucket 12 is inserted into opening 28 of retaining ring 18 until the lower edge of the bucket frictionally interengages the tapered inner circumferential wall 31 of retaining ring 18. Preferably, the retaining ring has at least a slightly elastomeric or otherwise resilient composition which allows the retaining ring to snugly and frictionally engage the periphery of the bucket when the lower end of the bucket is urged into the ring.

Alternatively, a larger diameter bucket 12*a*, shown in phantom, may be inserted into opening 28 of retaining ring 18 such that it frictionally engages the retaining ring at a higher position (i.e. a shallower depth) within the retaining ring. In this manner, virtually any standard diameter mixing bucket may be inserted into the retaining ring and held securely therein for the mixing operation. Smaller diameter buckets are engaged progressively deeper within the retaining ring. In alternative embodiments, the inner circumference of the retaining ring may be perfectly cylindrical and lack a taper. In either event, the bucket received by the retaining ring is held securely in place during the mixing operation.

Apparatus 10 is assembled by first assembling forming protective shield 24 into a cylindrical shape as shown in FIGS. 3 and 4. The assembled shield is then inserted into groove 22 of channel 20 so that it surrounds and extends above retaining ring 26. A bucket 12, 12*a* is then introduced into the opening of retaining ring 18 such that protective shield 24 surrounds and extends above the inserted bucket. A worker W then stands upon the upper surface of base 16 such that the worker's weight bears fully upon the mat-like base. Each of the worker's feet is placed on the upper surface of base 16 on a respective side of the retaining ring 18. Worker W then inserts the blade 48 of a standard mixer 50 into the contents contained within the bucket. The worker operates mixer 50 and thoroughly mixes the contents until they are ready for use in the pertinent construction project.

Device 10 allows worker W to perform the mixing operation quickly and efficiently. The mixing bucket is held securely in place by the retaining ring. The entire apparatus is held securely in place by the weight of the worker. The bucket is not jarred, dislodged or tipped over during mixing. A single worker can perform the mixing operation without requiring a second worker to hold the bucket as the mixer is operated. This saves considerable worker time and related costs, and is much more efficient than pre-existing mixing techniques.

Apparatus 10 also allows the mixing operation to be performed in a much cleaner and less messy fashion. Shield 24 extends well above the accommodated bucket 12. Accordingly, mortar or other material is largely retained within the periphery of shield 24. The shield prevents the construction material from being splashed, thrown or other discharged onto surrounding clothing, tools and work areas. Subsequent clean-up is reduced and facilitated considerably.

Figure 6:
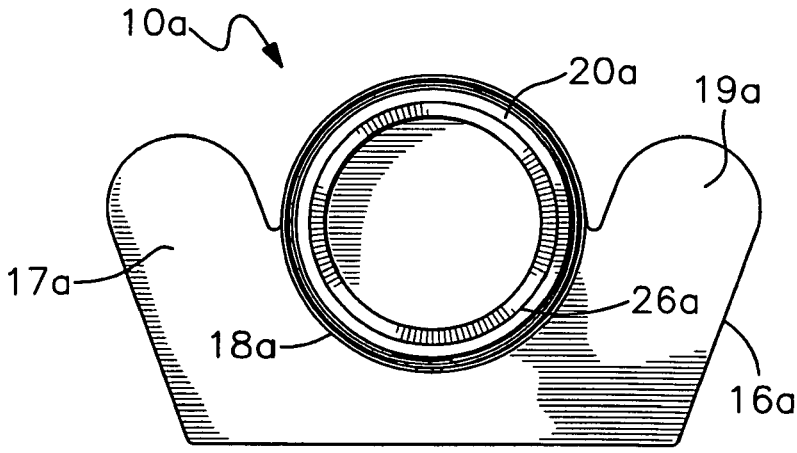
FIG. 6 is a plan view of an alternative version of the holder wherein the base platform is configured to generally represent the footprints of a worker using the holder.

A slightly altered holder apparatus 10*a* is depicted in FIG. 6. In this version, base 16*a* includes a pair of footprint sections 17*a* and 19*a*, which are respectively engaged by the worker's left and right feet. Once again, a retaining ring 18*a* is formed centrally in the base. As in the prior embodiment, the retaining ring includes a peripheral channel 20*a* that is designed to receive a protective shield (not shown in this version) in a manner analogous to that previously described. A tapered (or alternatively perfectly cylindrical) central body 26*a* receives a mixing bucket in the manner previously described. The worker again is allowed to stand upon base 16*a* so that an accommodated mixing bucket is held securely in place while the contents of the bucket are mixed by a single worker. It should be understood that, in still other versions, the configuration of the base or mat may be varied in a virtually unlimited manner. The apparatus of FIG. 6 provides benefits that are analogous to those achieved by the previously described embodiment. In particular, the mixing bucket is held securely in place so that a single worker is allowed to mix the contents in a relatively quick and labor efficient manner. Splashing and discharge of the contents are limited and post mixing cleanup is facilitated greatly.

From the foregoing it may be seen that the apparatus of this invention provides for a mixing bucket and, more particularly, to a device that holds a bucket containing mortar, thinset and similar substances in place so that mixing of the contents is facilitated. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

Other embodiments will occur to those skilled in the art and are within the following claims:

What is claimed is:

1. A holder for a mixing bucket, the contents of which bucket are mixable therein, said holder comprising:

a base for being stood upon and held in place by a person mixing the contents of the bucket;

a bucket retainer attached to and extending upwardly from said base, said retainer for disposing peripherally about the bucket and restricting movement thereof while the contents of the bucket are mixed by a person standing on said base; and a protective shield that is attachable to and extendable about said retainer for surrounding a bucket disposed within said retainer to limit discharge of contents of the bucket while such contents are mixed, said retainer including a channel defining a groove for receiving said shield to attach said shield to container.

2. The device of claim 1 in which said base includes a generally flat platform.

3. The device of claim 1 in which said retainer includes a retaining ring that extends axially upwardly from said base and has a central opening for receiving the bucket with mixable contents therein.

4. The device of claim 1 in which said shield includes a flexible, generally flat shield component that is wrappable into a generally cylindrical condition for inserting said shield into said annular groove.

5. The device of claim 4 in which said shield component includes complementary fastening elements located proximate respective ends of said shield component, said fastening elements being selectively interengagable to hold said shield component in said generally cylindrical condition.

6. The device of claim 1 in which said retainer is configured for peripherally engaging the mixing bucket and frictionally gripping the bucket to restrict movement thereof while the contents of the bucket are mixed.

7. A holder for a mixing bucket, the contents of which bucket are mixable within the bucket, said holder comprising:

a base for being stood upon and held in place by a person mixing the contents of the bucket;

a bucket retaining ring attached to and extending axially upwardly from said base, said ring having a central opening for receiving the mixing bucket therein such that said ring retains the bucket and restricts movement thereof while the contents of the bucket are mixed by a person standing on the base; and a generally cylindrical shield attachable to and axially extendable about said retaining ring for peripherally surrounding a bucket received within said central opening of said ring to limit discharge of the contents of the bucket while such contents are mixed, said ring including a channel defining an annular groove for receiving said shield to attach said shield to said retaining ring.

8. The device of claim 7 in which said base includes a generally flat platform.

9. The device of claim 7 in which said shield includes a flexible, generally flat shield component that is wrappable into a generally cylindrical condition for inserting said shield into said annular groove.

10. The device of claim 9 in which said shield component includes complementary fastening elements located proximate respective ends of said shield component, said fastening elements being selectively interengagable to hold said shield component in said generally cylindrical condition.

11. The device of claim 7 in which said retainer is configured for peripherally engaging the mixing bucket and frictionally gripping the bucket to restrict movement thereof while the contents of the bucket are mixed.

12. The device of claim 11 in which said ring includes a longitudinally tapered interior circumferential surface for frictionally engaging and holding buckets of varying diameters at respective depths within said retaining ring.

13. The device of claim 12 in which said retaining ring includes an interior circumference that decreases in size from an upper end to a lower end of said ring, whereby said ring is peripherally frictionally engagable with progressively smaller diameter buckets as the depth within said ring increases.

* * * * *